US012478845B2

(12) United States Patent
Furuhi et al.

(10) Patent No.: US 12,478,845 B2
(45) Date of Patent: Nov. 25, 2025

(54) GRIP FORCE ESTIMATION DEVICE AND GRIP FORCE ESTIMATION METHOD

(71) Applicant: Murata Manufacturing Co., Ltd., Kyoto (JP)

(72) Inventors: Tomoshige Furuhi, Kyoto (JP); Nobuyuki Nozawa, Kyoto (JP); Koji Kawano, Kyoto (JP); Takehiko Iizuka, Kyoto (JP); Jun Makino, Kyoto (JP); Takashi Watanabe, Kyoto (JP); Kenta Ago, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 350 days.

(21) Appl. No.: 18/446,090

(22) Filed: Aug. 8, 2023

(65) Prior Publication Data

US 2023/0381612 A1 Nov. 30, 2023

Related U.S. Application Data

(63) Continuation of application No. PCT/JP2021/042869, filed on Nov. 24, 2021.

(30) Foreign Application Priority Data

Feb. 10, 2021 (JP) ..... 2021-019523

(51) Int. Cl.
*A63B 60/46* (2015.01)
*A63B 102/32* (2015.01)

(52) U.S. Cl.
CPC ..... *A63B 60/46* (2015.10); *A63B 2060/464* (2015.10); *A63B 2102/32* (2015.10); *A63B 2220/51* (2013.01)

(58) Field of Classification Search
CPC ..... A63B 60/46; A63B 2060/464; A63B 2102/32; A63B 2220/51; A63B 24/0006;
(Continued)

(56) References Cited

U.S. PATENT DOCUMENTS 4,138,118 A 2/1979 Budney
5,351,951 A 10/1994 Hodgetts
5,857,694 A 1/1999 Lazarus et al.
(Continued)

FOREIGN PATENT DOCUMENTS

JP 2001-523979 A 11/2001
JP 2003-240672 A 8/2003
(Continued)

OTHER PUBLICATIONS

International Search Report for PCT/JP2021/042869 dated Dec. 28, 2021.

*Primary Examiner* — Nini F Legesse
(74) *Attorney, Agent, or Firm* — McDonald Hopkins LLC

(57) ABSTRACT

A grip force estimation device includes a sensor that is attached to sports equipment including a columnar portion having a grip portion at one end and a hitting portion connected to the columnar portion and is attached not at the grip portion but at the columnar portion, and that is configured to detect at least one of bending and twisting of the sports equipment and output detected bending and/or twisting as a sensor signal, a feature data extraction unit configured to extract feature data including a feature when a waveform generated by the hitting portion being externally applied with pressure is attenuated by using the sensor signal, and a grip force estimation unit configured to estimate pressure applied to the grip portion by using the feature data.

10 Claims, 6 Drawing Sheets

(58) Field of Classification Search
CPC ..... A63B 24/0062; A63B 69/3632; A63B 2024/0068; A63B 2220/62; A63B 2220/803; A63B 2225/50; A63B 53/10; A63B 71/0622
USPC ..... 473/118, 131, 201, 202, 219, 221, 222, 473/223, 226, 247, 318, 409
See application file for complete search history.

(56) References Cited

U.S. PATENT DOCUMENTS 6,441,745 B1 * 8/2002 Gates ..... A63B 69/3632 340/672
6,716,034 B2 * 4/2004 Casanova, Jr. ..... A63B 69/36 473/202
8,864,598 B2 * 10/2014 Worobets ..... A63B 60/42 473/219
2003/0036436 A1 * 2/2003 Casanova, Jr. ..... A63B 69/36 473/202
2006/0052173 A1 * 3/2006 Telford ..... G01P 1/023 473/131
2010/0210371 A1 * 8/2010 Sato ..... A63B 60/42 473/223
2011/0190069 A1 * 8/2011 Slane ..... A63B 53/14 473/202
2014/0290332 A1 10/2014 Yamashita et al.
2021/0213327 A1 7/2021 Ohta et al.

FOREIGN PATENT DOCUMENTS

JP 2013-247987 A 12/2013
JP 2014-226165 A 12/2014
JP 2018-175496 A 11/2018
WO 99/25432 A1 5/1999
WO 2013/069447 A1 5/2013

* cited by examiner

GRIP FORCE ESTIMATION DEVICE AND GRIP FORCE ESTIMATION METHOD

CROSS REFERENCE TO RELATED APPLICATION

This is a continuation of International Application No. PCT/JP2021/042869 filed on Nov. 24, 2021 which claims priority from Japanese Patent Application No. 2021-019523 filed on Feb. 10, 2021. The contents of these applications are incorporated herein by reference in their entireties.

BACKGROUND ART

Technical Field

The present disclosure relates to a technique for detecting force for holding sports equipment.

Patent Document 1 describes a device that analyzes a user's motion of swinging a golf club, by a sensor device attached to a shaft.

The sensor device of Patent Document 1 includes a plurality of sensors. Specifically, the sensors are an acceleration sensor, an angular velocity sensor and a distortion sensor. The device analyzes a swing of the golf club by the user, based on information obtained from the acceleration sensor and the angular velocity sensor and information obtained from distortion of the shaft.

Patent Document 1: Japanese Unexamined Patent Application Publication No. 2018-175496

BRIEF SUMMARY

However, in an existing configuration as illustrated in Patent Document 1, force of the user holding a grip is not taken into consideration. Thus, depending on how the user holds the grip, it is likely that an analysis result may be affected.

The present disclosure provides a device of a simple structure, capable of more accurately detecting whether or not a grip of a golf club is held in a normal manner.

A grip force estimation device of the present disclosure includes a sensor that is attached to sports equipment including a columnar portion having a grip portion at one end and a hitting portion connected to the columnar portion and is attached not at the grip portion but at the columnar portion, and that is configured to detect at least one of bending and twisting of the sports equipment and output detected bending and/or twisting as a sensor signal, a feature data extraction unit configured to extract feature data including a feature when a waveform generated by the hitting portion being externally applied with pressure is attenuated by using the sensor signal, and a grip force estimation unit configured to estimate pressure applied to the grip portion by using the feature data.

In this configuration, a simple structure enables to detect whether or not the grip portion of the sports equipment is properly held.

According to the present disclosure, a simple structure enables to more accurately detect whether or not a grip portion of sports equipment is properly held. For example, when the sports equipment is a golf club, it is possible to detect whether or not a grip of the golf club is properly held.

DETAILED DESCRIPTION

First Embodiment

Figure 1:
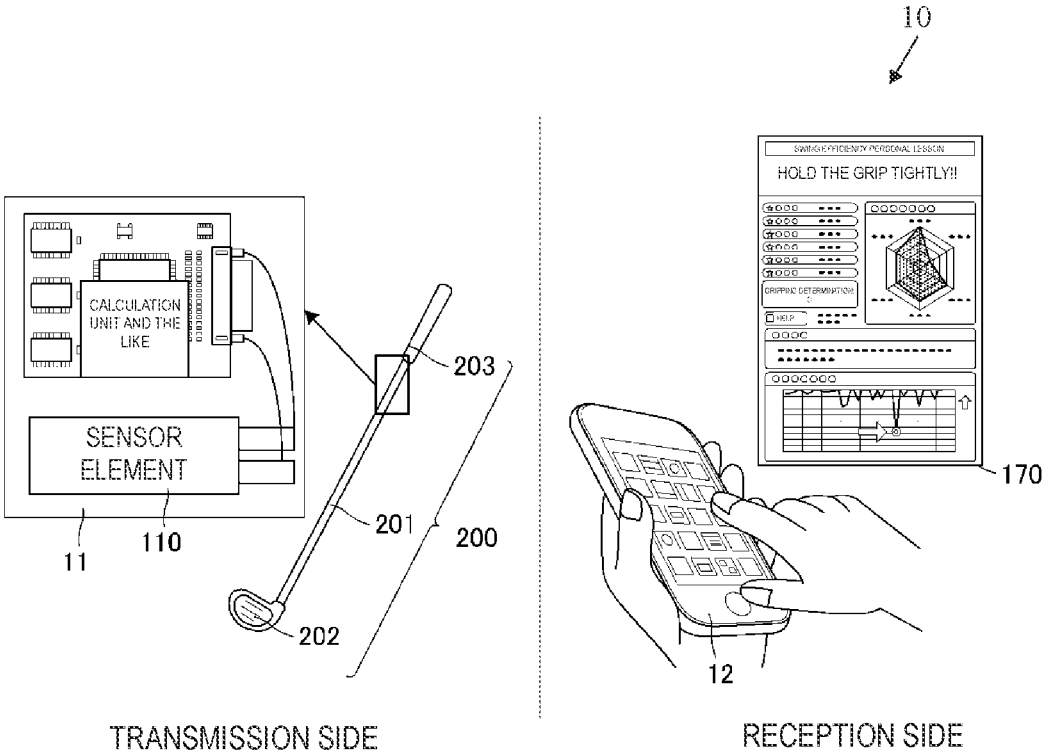
FIG. 1 is a schematic diagram of a grip force estimation device 10 according to a first embodiment.
Figure 2:
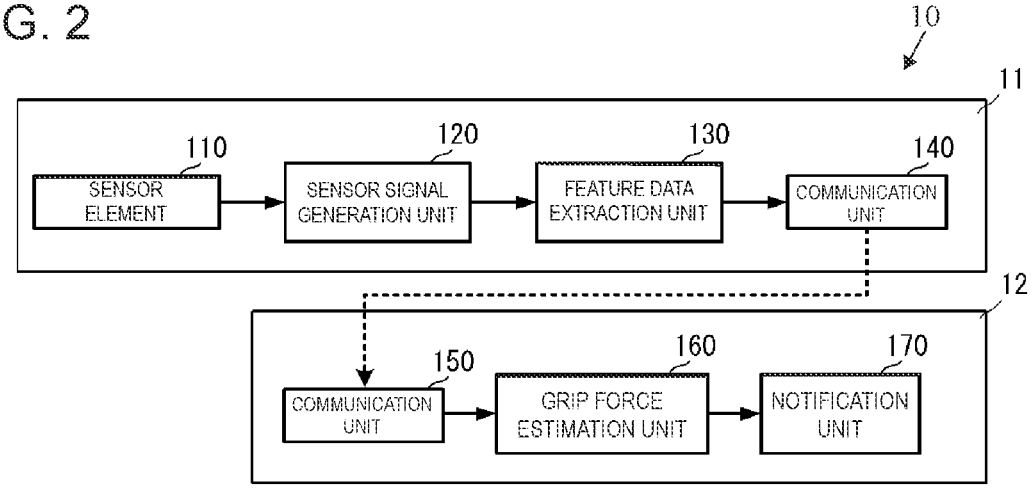
FIG. 2 is a block diagram of the grip force estimation device 10 according to the first embodiment.
Figure 3:
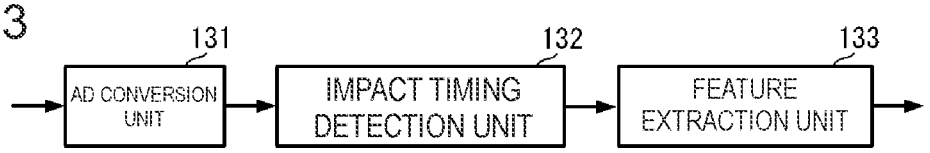
FIG. 3 is a block diagram of a feature data extraction unit 130 of the grip force estimation device 10 according to the first embodiment.
Figure 4:
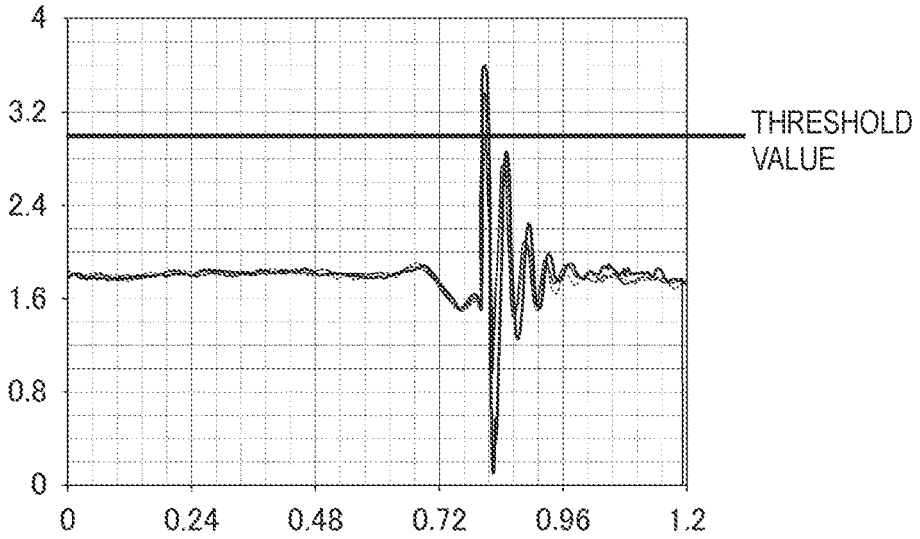
FIG. 4 is a graph showing voltage detected by operating the grip force estimation device 10 according to the first embodiment.
Figure 5A:
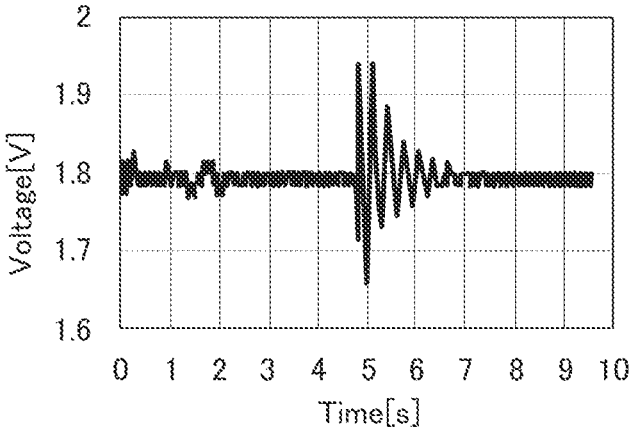
FIG. 5A is a graph obtained by cutting out certain seconds out of a feature of voltage detected by operating the grip force estimation device 10 according to the first embodiment.
Figure 5B:
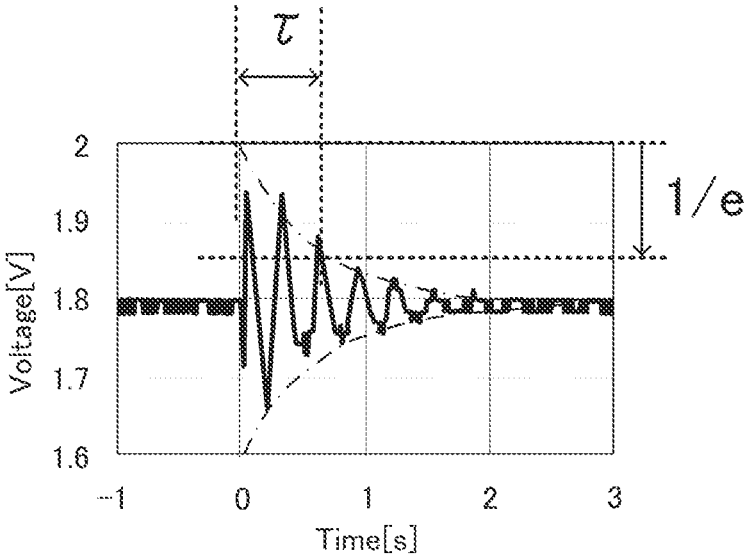
FIG. 5B is a graph showing an example of calculating a decay time constant from the graph of FIG. 5A.
Figure 6A:
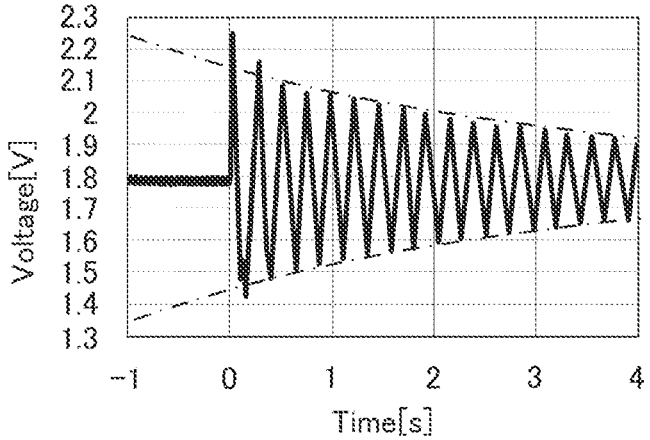
FIG. 6A, FIG. 6B, and FIG. 6C are each a graph showing natural frequency obtained from the grip force estimation device 10 according to the first embodiment.
Figure 6B:
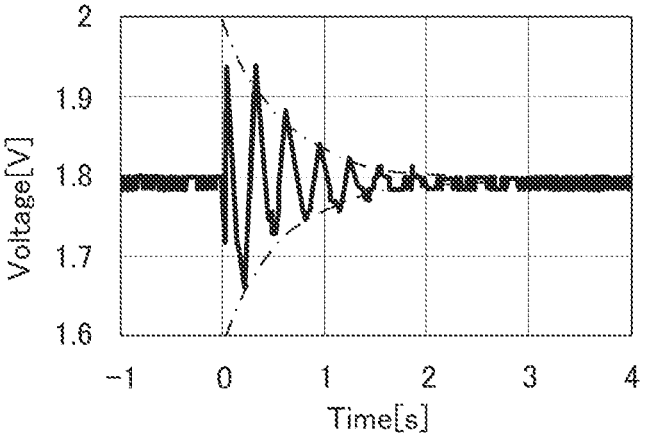
Figure 6C:
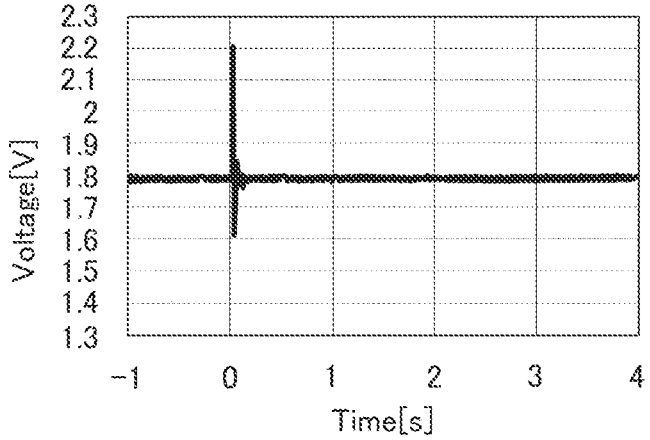
Figure 7:
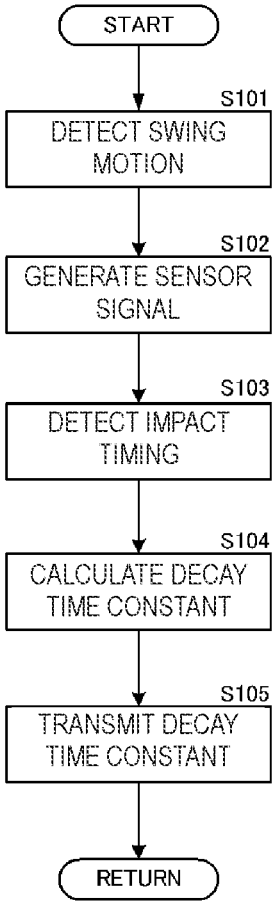
FIG. 7 is a flowchart illustrating operation of a transmission-side device 11 of the grip force estimation device 10 according to the first embodiment.
Figure 8:
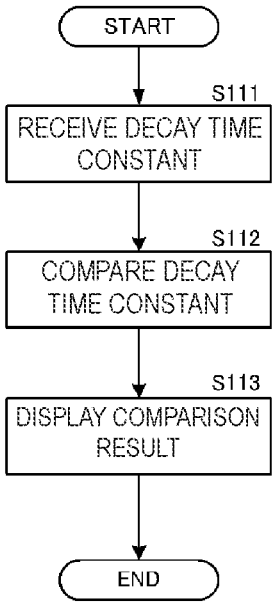
FIG. 8 is a flowchart illustrating operation of a reception-side device 12 of the grip force estimation device 10 according to the first embodiment.

A grip force estimation device according to a first embodiment of the present disclosure will be described with reference to the drawings. FIG. 1 is a schematic diagram of the grip force estimation device 10 according to the first embodiment. FIG. 2 is a block diagram of the grip force estimation device 10 according to the first embodiment. FIG. 3 is a block diagram of the feature data extraction unit 130 of the grip force estimation device 10 according to the first embodiment. FIG. 4 is a graph showing voltage detected by operating the grip force estimation device 10 according to the first embodiment. FIG. 5A is a graph obtained by cutting out certain seconds out of a feature of voltage detected by operating the grip force estimation device 10 according to the first embodiment, and FIG. 5B is a graph showing an example of calculating a decay time constant from the graph of FIG. 5A. FIG. 6A, FIG. 6B, and FIG. 6C are each a graph showing natural frequency obtained from the grip force estimation device 10 according to the first embodiment. FIG. 7 is a flowchart illustrating operation of the transmission-side device 11 of the grip force estimation device 10 according to the first embodiment. FIG. 8 is a flowchart illustrating operation of the reception-side device 12 of the grip force estimation device 10 according to the first embodiment. Note that in order to make a configuration of the grip force estimation device easier to understand, shapes of components are partially or entirely exaggerated in each drawing.

(Outline of Grip Force Estimation Device)

An outline of the grip force estimation device 10 will be illustrated using FIG. 1. The grip force estimation device 10 includes the transmission-side device 11 and the reception-side device 12. As illustrated in FIG. 1, the transmission-side device 11 is attached to a surface of a shaft 201 of a golf club 200.

The golf club 200 is, for example, a driver. The golf club 200 is not limited to a driver, and may be any of a fairway wood, a utility, an iron, a wedge and a putter. Note that the golf club 200 corresponds to "sports equipment" of the present disclosure, the shaft 201 corresponds to a "columnar portion" of the present disclosure, a grip 203 corresponds to a "grip portion" of the present disclosure and a head 202 corresponds to a "hitting portion" of the present disclosure.

A user hits a golf ball using the golf club 200 (a swing motion). At this time, a sensor element 110 detects a bend component due to this swing motion. The transmission-side device 11 calculates a decay time constant using a sensor signal calculated from the bend component.

The transmission-side device 11 transmits the decay time constant to the reception-side device 12. The reception-side device 12 receives the decay time constant. The reception-side device 12 compares the decay time constant with a decay time constant provided as a reference. With this, the reception-side device 12 determines whether or not the grip 203 is properly held. The reception-side device 12 performs processing such as graphing. The user checks a feature that is displayed via a GUI such as being graphed. Note that this feature indicates whether or not the grip 203 is properly held when the user performs a swing, or the like. Furthermore, it will be good if advice on the user's swing on how to hold the grip 203 is to be displayed.

(Details of Grip Force Estimation Device)

Next, a detailed configuration of the grip force estimation device 10 will be described using FIG. 1, FIG. 2, FIG. 3, FIG. 4, FIG. 5A, FIG. 5B, FIG. 6A, FIG. 6B, FIG. 6C, FIG. 7, and FIG. 8. The transmission-side device 11 of the grip force estimation device 10 includes the sensor element 110, a sensor signal generation unit 120, a feature data extraction unit 130, and a communication unit 140 (e.g., a transmitter). The feature data extraction unit 130 includes an AD conversion unit 131, an impact timing detection unit 132, and a feature extraction unit 133.

The sensor signal generation unit 120, the feature data extraction unit 130 and the communication unit 140 are achieved by, for example, a plurality of electronic circuit elements such as processors or ICs mounted on a circuit board or the like.

The reception-side device 12 of the grip force estimation device 10 includes a communication unit 150, a grip force estimation unit 160, and a notification unit 170 (e.g., a display). Note that it is sufficient that the reception-side device 12 is a device including a communicator, a displayer, and the like, such as a smart phone or a tablet.

Detailed configuration of the grip force estimation device 10 and a flow of processing will be described. The user hits a golf ball using the golf club 200 (a swing motion).

When the user hits the golf ball, the golf ball collides with the head 202 of the golf club 200 (impact). This causes the golf ball to fly forward. At this time, repulsive force is transmitted to the head 202 at the moment of impact, and the repulsive force is transmitted to the shaft 201. This repulsive force causes the shaft 201 to bend. Note that the repulsive force is force generated when the head 202 externally receives pressure.

The sensor element 110 detects this bending. More specifically, the sensor element 110 includes a film-like main body having piezoelectric properties and a detection electrode. The main body contains, for example, polylactic acid as a main component and is polarized according to bending and twisting. The detection electrode is attached to a surface of the shaft 201. The detection electrode is attached to the shaft 201 such that charge due to bending and charge due to twisting can be outputted.

When the sensor element 110 is used, a polarization direction changes according to a bending direction and a twisting direction. Additionally, magnitude of charge generated by the polarization differs according to magnitude of the bending and magnitude of the twisting. When the user swings the golf club 200, a large amount of charge is generated at the time of strong shock such as an impact, and a small amount of charge is generated at the time of small shock without necessarily an impact. Further, this charge also varies depending on how the user is holding the grip 203.

The sensor signal generation unit 120 generates a voltage signal from the charge generated in the sensor element 110. The sensor signal generation unit 120 is achieved by a predetermined electronic circuit. The sensor signal generation unit 120 includes, for example, an integration circuit, and generates a sensor signal which is a voltage signal from the charge generated in the sensor element 110.

The sensor signal generation unit 120 outputs the sensor signal to the feature data extraction unit 130. The AD conversion unit 131 performs AD conversion (analog-to-digital conversion) on the sensor signal. The AD conversion unit 131 outputs the digitized sensor signal to the impact timing detection unit 132.

As shown in FIG. 4, the impact timing detection unit 132 detects, for example, timing at which the sensor signal exceeds a threshold value, and detects the detected timing as impact timing. The impact timing detection unit 132 outputs the sensor signal and the impact timing to the feature extraction unit 133.

Note that a value used as the threshold value by the impact timing detection unit 132 can be arbitrarily set. The threshold value may be determined based on, for example, a type of the golf club 200, or may be determined based on gender or a body type of the user. In addition, the impact timing detection unit 132 may use a value for which a large sensor signal is outputted as impact timing without necessarily using the threshold value.

As described above, the grip force estimation device 10 can detect impact timing only by output (a sensor signal) from the sensor element 110 attached to the shaft 201.

As shown in FIG. 5A, the feature extraction unit 133 extracts sensor signals in a period of a predetermined length starting from impact timing and outputs, as the feature extraction unit 133, the sensor signals. More specifically, the feature extraction unit 133 cuts out several seconds (for example, four seconds) before and after the impact timing as shown in FIG. 5B.

FIG. 5B is a graph showing a method of calculating a decay time constant from a waveform cut out by the feature extraction unit 133. More specifically, the feature extraction unit 133 determines a time $\tau$ until which a value of a voltage (amplitude) reaches 1/e (e is a base of a natural logarithm). The time $\tau$ is the decay time constant.

The feature data extraction unit 130 transmits the decay time constant $\tau$ to the reception-side device 12 via the communication unit 140. The communication unit 140 performs wireless communication. This wireless communication is, for example, Bluetooth (registered trademark) Low Energy (BLE). By using BLE, it is possible to achieve communication in a power saving manner, in which affinity with a device such as a smart phone is improved, and convenience is enhanced.

The communication unit 150 of the reception-side device 12 receives the decay time constant τ. The communication unit 150 outputs the decay time constant τ to the grip force estimation unit 160. The grip force estimation unit 160 compares the decay time constant τ with decay time constants under a plurality of conditions. Note that the decay time constants under the plurality of conditions correspond to reference values (details will be described later) of the present disclosure.

Detailed processing of the grip force estimation unit 160 will be described. The grip force estimation unit 160 stores decay time constants at natural frequencies serving as reference in advance. The natural frequencies serving as reference (reference values) correspond to a first natural frequency, a second natural frequency and a third natural frequency. At this time, an upper limit is the first natural frequency and a lower limit is the third natural frequency. The second natural frequency is an intermediate value between the first natural frequency and the third natural frequency.

The respective natural frequencies are defined using FIG. 6A, FIG. 6B and FIG. 6C. The first natural frequency is, for example, a natural frequency when an entirety of the grip 203 is horizontally fixed with force of 10 kgf, that is, when the grip 203 is fixed with strong force. Changes in attenuation of the natural frequency are shown in FIG. 6A. FIG. 6A is characterized in that influence of a frequency (for example, about 4 Hz) due to bending of the head 202 due to elasticity of the shaft 201 is large. Since the grip 203 is fixed with strong force, dissipation of energy is small and vibration continues for a long time.

The second natural frequency is, for example, a natural frequency when the grip 203 is fixed horizontally and lightly (for example, force of 3 kgf), that is, when the grip 203 is fixed with light force. Changes in attenuation of the natural frequency are shown in FIG. 6B. FIG. 6B is characterized in that since the force for fixing the grip 203 is smaller as compared to the first natural frequency, the frequency due to the bending of the head 202 decreases (for example, about 3 Hz). Since the grip 203 is fixed with light force, energy is dissipated, thus the natural frequency is attenuated faster as compared to FIG. 6A.

The third natural frequency is a natural frequency when an upper end of the grip 203 is fixed with light force, that is, when the grip 203 is not substantially fixed. Changes in attenuation of the natural frequency are shown in FIG. 6C. FIG. 6C is characterized in that only high-frequency vibrations are generated and quickly attenuated.

Decay time constants are calculated from these natural frequencies. A decay time constant τ1 determined from the first natural frequency is about 4 seconds. A decay time constant τ2 determined from the second natural frequency is about 0.6 seconds. A decay time constant τ3 determined from the third natural frequency is substantially second.

The grip force estimation unit 160 compares the decay time constant τ with these decay time constants τ1, τ2, and τ3. These decay time constants τ1, τ2, and τ3 correspond to the reference values of the present disclosure. The decay time constant τ1 is a reference value when grip force is strong. The decay time constant τ2 is a reference value when the grip force is medium. The decay time constant τ3 is a reference value when the grip force is weak.

At this time, the decay time constants τ1, τ2 and τ3 satisfy a relational expression of τ3<τ2<τ1. When the decay time constant τ satisfies a relationship of τ3<the decay time constant τ<τ2, the grip force estimation unit 160 estimates that the grip 203 is fixed with weak force. In addition, when the decay time constant τ satisfies a relationship of τ2<the decay time constant τ<τ1, the grip force estimation unit 160 estimates that the grip 203 is fixed with strong force. In addition, the grip force estimation unit 160 may determine how strong (slightly strong, slightly weak, or the like) the grip force is depending on which value of the decay time constants τ1, τ2, and τ3 the decay time constant τ is close to.

Note that when the decay time constants τ1, τ2, and τ3 can be expressed by a function, the function may be used to express the strength at which the grip 203 is fixed.

Description will be given using more specific values. When the decay time constant τ is 3 seconds, the grip force estimation unit 160 determines that the grip 203 is fixed with strong force by the user. When the decay time constant τ is 0.8 seconds, the grip force estimation unit 160 determines that the grip 203 is fixed with medium force by the user. When the decay time constant τ is 0.1 seconds, the grip force estimation unit 160 determines that the grip 203 is fixed with light force by the user.

The grip force estimation unit 160 outputs a result of the determination to the notification unit 170. The notification unit 170 displays the result via a GUI using a graph or the like as in the notification unit 170 illustrated in FIG. 1. The user checks his/her own way of holding the grip 203. The notification unit 170 displays how the user holds the grip, and the like are in a graph, and further, it is good that advice on how to hold the grip 203 may also be displayed. At this time, since how to hold the grip 203 is displayed on the notification unit 170 using the graph, an advantage is obtained that it is easy for the user to visually understand.

Note that the notification unit 170 may also be configured to display only the determination result. For example, determination values for grip force may be set according to strength such as A, B or C in advance, and when the grip force is A, it may be determined that the user is holding the grip 203 with strong force, or the like.

A flow of processing of the grip force estimation device 10 will be described using FIG. 7 and FIG. 8. First, FIG. 7 is used to describe a flow of processing of the transmission-side device 11.

The sensor element 110 detects bending caused by a swing motion (S101).

The sensor signal generation unit 120 generates a voltage signal (sensor signal) from charge generated in the sensor element 110. The sensor signal generation unit 120 outputs the voltage signal to the feature data extraction unit 130 (S102).

The feature data extraction unit 130 calculates an absolute value of a voltage after AD conversion, and detects timing at which the head 202 of the golf club 200 impacts on a golf ball from timing at which the absolute value of the voltage exceeds a threshold value (S103).

The feature data extraction unit 130 cuts off a certain period of time (several seconds) starting from the impact timing, and calculates a decay time constant (S104).

The feature data extraction unit 130 transmits the decay time constant to the reception-side device 12 via the communication unit 140 (S105).

Next, FIG. 8 is used to describe a flow of processing of the reception-side device 12.

The communication unit 150 of the reception-side device 12 receives the decay time constant (S111).

The communication unit 150 outputs the decay time constant to the grip force estimation unit 160. The grip force estimation unit 160 compares the decay time constant with the reference values (S112).

The grip force estimation unit 160 outputs a result of the comparison to the notification unit 170. The notification unit 170 displays the result via a GUI (S113).

In this way, even with a simple structure in which the grip force estimation device 10 is attached only to the shaft 201, it is possible to accurately detect features such as how the user holds the grip 203 or how strong the user holds the grip 203. In addition, since the grip force estimation device attached to the shaft is very light in weight, usability of the user is not impaired.

In the above-described configuration, an attachment position of the transmission-side device 11 of the grip force estimation device 10 is not particularly predetermined. Accordingly, the user does not need to be aware of the attachment position, and convenience is improved.

Note that in the above-described configuration, the attachment position of the transmission-side device 11 is arbitrary. However, when the user swings a putter (the golf club 200), the transmission-side device 11 may be attached at a position close to the head 202. In this case, the sensor element 110 can accurately detect bending of the shaft 201 even when repulsive force from the golf ball is small. In other words, when the types of the golf club 200 are different but the attachment position of the transmission-side device 11 is the same, the type of the golf club 200 can be determined.

In the above, the configuration has been described above in which the grip force estimation unit 160 is included in the reception-side device 12. However, a configuration may be adopted in which the transmission-side device 11 includes the grip force estimation unit 160. In this case, the reception-side device 12 only needs to display a result. With this configuration, it is possible to provide a configuration that is not affected by a type and specifications of the reception-side device 12.

In addition, in the above-described configuration, the sensor element 110 detects bending of the shaft 201. However, the sensor element 110 may detect twisting of the shaft 201. In other words, it is sufficient that the sensor element 110 detects at least one of the bending and the twisting of the shaft 201.

Further, the grip force estimation device 10 in the first embodiment may be configured to include a storage unit in which history data of the user can be saved. In this case, a history of data to be outputted to the notification unit 170 can be displayed. With this configuration, it is possible to perform comparison with grip force calculated from a swing in the past, or the like.

Further, a result may be displayed in which not only the comparison of the grip force but also a swing motion including the time of impact is included. In this case, it is possible to simultaneously analyze influence of the way of holding the grip 203 on the swing motion.

Second Embodiment

Figure 9:
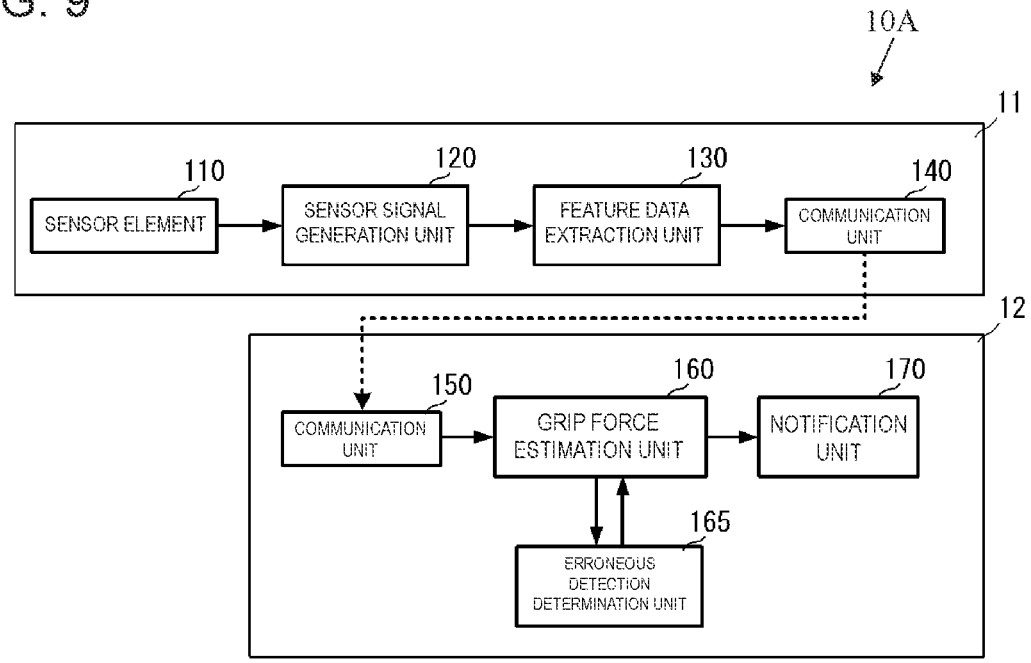
FIG. 9 is a block diagram of a grip force estimation device 10A according to a second embodiment.
Figure 10:
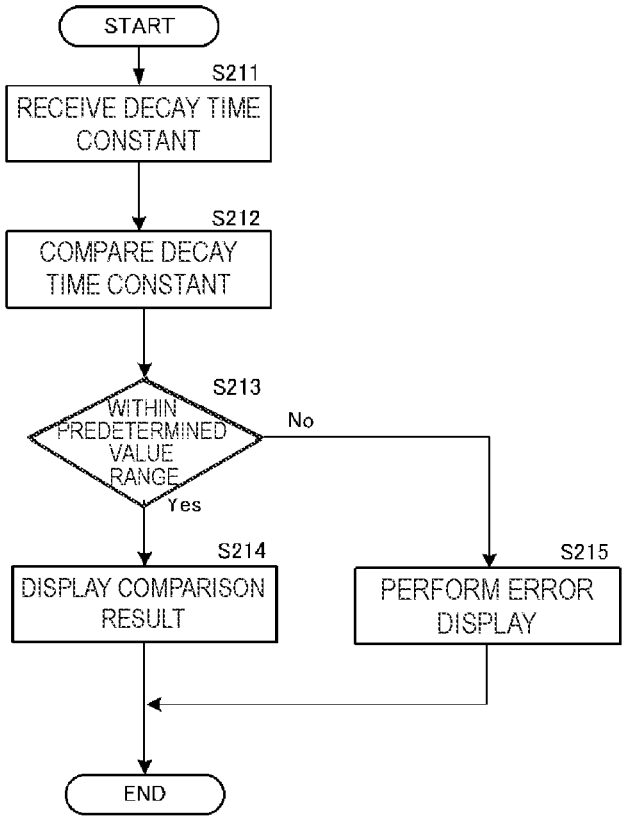
FIG. 10 is a flowchart illustrating operation of a reception-side device 12A of the grip force estimation device 10A according to the second embodiment.

A grip force estimation device according to a second embodiment of the present disclosure will be described with reference to the drawings. FIG. 9 is a block diagram of the grip force estimation device 10A according to the second embodiment. FIG. 10 is a flowchart illustrating operation of the reception-side device 12A of the grip force estimation device 10A according to the second embodiment.

As illustrated in FIG. 9 and FIG. 10, the grip force estimation device 10A according to the second embodiment is different from the grip force estimation device 10 according to the first embodiment in a configuration of the reception-side device 12A. Other configurations of the grip force estimation device 10A are the same as those of the grip force estimation device 10, and description of the same portions will be omitted.

As illustrated in FIG. 9, the grip force estimation device 10A includes the transmission-side device 11 and the reception-side device 12A. The reception-side device 12A includes the communication unit 150, the grip force estimation unit 160, an erroneous detection determination unit 165 and the notification unit 170.

The erroneous detection determination unit 165 determines whether or not an abnormality occurs in a decay time constant. A more specific flow of processing will be described using FIG. 10.

The communication unit 150 of the reception-side device 12A receives a decay time constant (S211).

The communication unit 150 outputs the decay time constant to the grip force estimation unit 160. The grip force estimation unit 160 compares the decay time constant with the reference values (S212).

The grip force estimation unit 160 outputs the decay time constant $\tau$ to the erroneous detection determination unit 165. The erroneous detection determination unit 165 determines whether or not the decay time constant $\tau$ is included in a range between the decay time constant $\tau 1$ and the decay time constant $\tau 3$ (the decay time constant $\tau 3$<the decay time constant $\tau$<the decay time constant $\tau 1$) (S213).

When the decay time constant $\tau$ is included in the range of the decay time constants $\tau 1$, $\tau 2$, and $\tau 3$, the erroneous detection determination unit 165 determines that the decay time constant $\tau$ is a normal value and outputs the determination to the grip force estimation unit 160 (S213: Yes).

The grip force estimation unit 160 outputs a result of comparison between the decay time constant $\tau$ and the reference values to the notification unit 170. The notification unit 170 displays the result (normal result) via a GUI (S214).

When the decay time constant $\tau$ is smaller than the decay time constant $\tau 3$ (for example, when the decay time constant $\tau$ is 0 seconds), the grip force estimation unit 160 determines that the decay time constant $\tau$ is an abnormal value and outputs a result of the determination to the grip force estimation unit 160 (S213: No). Similarly, when the decay time constant $\tau$ is greater than the decay time constant it (for example, when the decay time constant $\tau$ is 5 seconds), the grip force estimation unit 160 determines that the decay time constant $\tau$ is an abnormal value and outputs a result of the determination to the grip force estimation unit 160 (S213: No).

The grip force estimation unit 160 outputs a result of comparison (error result) between the decay time constant $\tau$ and the reference values to the notification unit 170. The notification unit 170 displays the result via the GUI (S215).

In this way, even with a simple structure in which the grip force estimation device 10A is attached only to the shaft 201, it is possible to accurately detect features when a user holds the grip 203. Further, when an abnormality occurs in the grip force estimation device 10A, determination is not performed using abnormal data, thus, it is possible to more accurately detect the features when the user holds the grip 203.

Third Embodiment

Figure 11:
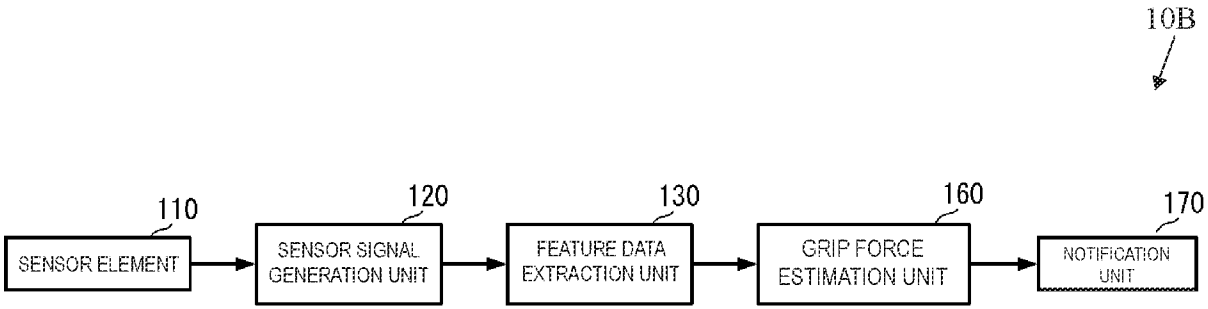
FIG. 11 is a block diagram of a grip force estimation device 10B according to a third embodiment.

A grip force estimation device according to a third embodiment of the present disclosure will be described with reference to the drawings. FIG. 11 is a block diagram of the grip force estimation device 10B according to the third embodiment.

As illustrated in FIG. 11, the grip force estimation device 10B according to the third embodiment is different from the grip force estimation device 10 according to the first embodiment in that the configurations of the transmission-side device 11 and the reception-side device 12 in the first embodiment are included. Other configurations of the grip force estimation device 10B are similar to those of the grip force estimation device 10, and description of similar portions will be omitted.

As illustrated in FIG. 11, the grip force estimation device 10B includes the sensor element 110, the sensor signal generation unit 120, the feature data extraction unit 130, the grip force estimation unit 160 and the notification unit 170. The notification unit 170 has a simple notification function similar to that of an LED. The notification unit 170 gives notice of a result of a swing by a user using colors, a symbol that can be expressed by one character, or the like.

The grip force estimation unit 160 compares the decay time constant $\tau$ with the decay time constants $\tau 1$, $\tau 2$, and $\tau 3$ (reference values). The grip force estimation unit 160 calculates a simple result such as OK or NG of a way of holding the grip 203 from a result of the comparison. The grip force estimation unit 160 outputs the simple result to the notification unit 170. The notification unit 170 changes colors of the LED, based on the simple result. Thus, the user can visually determine whether or not the result of the swing is normal.

In this way, even with a simple structure in which the grip force estimation device 10B is attached only to the shaft 201, it is possible to accurately detect features when the user holds the grip 203. Furthermore, in the grip force estimation device 10B, a problem that a result is not displayed due to a communication failure or the like can be solved when a configuration not including a communication unit is used.

Note that in the above description, the aspect in which the golf club is used as the sports equipment has been described. However, the configuration of the present disclosure can be applied to any sports equipment (for example, a bat for baseball or the like, or a racket for tennis, badminton, or the like), and the same effects can be obtained, as long as the sports equipment has a columnar portion and displacement occurs in the columnar portion when impacted by a desired object such as a ball, a shuttle, or the like.

REFERENCE SIGNS LIST

10, 10A, 10B GRIP FORCE ESTIMATION DEVICE
11 TRANSMISSION-SIDE DEVICE
12, 12A RECEPTION-SIDE DEVICE
110 SENSOR ELEMENT
120 SENSOR SIGNAL GENERATION UNIT
130 FEATURE DATA EXTRACTION UNIT
131 AD CONVERSION UNIT
132 IMPACT TIMING DETECTION UNIT
133 FEATURE EXTRACTION UNIT
140, 150 COMMUNICATION UNIT
160 GRIP FORCE ESTIMATION UNIT
165 ERRONEOUS DETECTION DETERMINATION UNIT
170 NOTIFICATION UNIT
200 GOLF CLUB
201 SHAFT
202 HEAD
203 GRIP
$\tau$, $\tau 1$, $\tau 2$, $\tau 3$ DECAY TIME CONSTANT

The invention claimed is:

1. A grip force estimation device for sports equipment including a columnar portion having a grip portion at one end and a hitting portion connected to the columnar portion, comprising:

a sensor that is attached to the columnar portion and is not attached to the grip portion, and that is configured to detect bending or twisting of the sports equipment and to output the detected bending and/or twisting as a sensor signal; and a processor configured to:

extract attenuation feature data of a waveform of the sensor signal when external pressure is applied to the hitting portion, and estimate a pressure applied to the grip portion by using the attenuation feature data.

2. The grip force estimation device according to claim 1, wherein the processor is further configured to determine a way the grip portion is held by using a spectral intensity of a specific frequency of a bend component of the sensor signal.

3. The grip force estimation device according to claim 2, wherein the processor is further configured to:

detect a decay time constant from the spectral intensity of the specific frequency, and determine a strength of how the grip portion is held by comparing the decay time constant with a reference value.

4. The grip force estimation device according to claim 3, further comprising a transmitter configured to transmit the determined strength of how the grip portion is held.

5. The grip force estimation device according to claim 1, further comprising a display configured to display a result obtained by analyzing the determined strength of how the grip portion is held.

6. A grip force estimation method for sports equipment including a columnar portion having a grip portion at one end and a hitting portion connected to the columnar portion, comprising the steps of:

detecting, by a sensor attached to the columnar portion and not attached to the grip portion, bending or twisting of the sports equipment;

outputting, by the sensor, the detected bending and/or twisting as a sensor signal;

extracting attenuation feature data of a waveform of the sensor signal when external pressure is applied to the hitting portion; and estimating a pressure applied to the grip portion by using the feature data.

7. The grip force estimation method according to claim 6, further comprising:

determining a way the grip portion is held by using a spectral intensity of a specific frequency of a bend component of the sensor signal.

8. The grip force estimation method according to claim 7, further comprising:

detecting a decay time constant from the spectral intensity of the specific frequency, and determining a strength of how the grip portion is held by comparing the decay time constant with a reference value.

9. The grip force estimation method according to claim 8, further comprising:

transmitting the determined strength of how the grip portion is held.

10. The grip force estimation method according to claim 6, further comprising:

displaying a result obtained by analyzing the determined strength of how the grip portion is held.

* * * * *